US006326903B1

(12) United States Patent
Gross et al.

(10) Patent No.: US 6,326,903 B1
(45) Date of Patent: Dec. 4, 2001

(54) EMERGENCY VEHICLE TRAFFIC SIGNAL PRE-EMPTION AND COLLISION AVOIDANCE SYSTEM

(76) Inventors: Dave Gross, 3610 Inwood Dr., Fort Wayne, IN (US) 46815; Jon Gross, 1615 Pentecost Way, #5, San Diego, CA (US) 92105

( * ) Notice: Subject to any disclaimer, the term of this patent is extended or adjusted under 35 U.S.C. 154(b) by 0 days.

(21) Appl. No.: 09/491,784

(22) Filed: Jan. 26, 2000

(51) Int. Cl.[7] ..... G08G 1/123

(52) U.S. Cl. ..... 340/988; 340/933; 340/902; 340/903; 701/301

(58) Field of Search ..... 340/988, 933, 340/935, 939, 916, 906, 907, 902, 903; 701/300, 301, 302; 455/67.5, 32.1

(56) References Cited

U.S. PATENT DOCUMENTS

| | | | |
|---|---|---|---|
| 3,209,325 | 9/1965 | Mentzer et al. | 340/33 |
| 3,233,217 | 2/1966 | Bost, Jr. | 340/33 |
| 3,247,482 | 4/1966 | Lesher | 340/41 |
| 3,412,378 | 11/1968 | Thomas | 340/34 |
| 3,660,811 | 5/1972 | Vail et al. | 340/33 |
| 3,673,560 | 6/1972 | Barsh et al. | 340/33 |
| 3,710,313 | 1/1973 | Kimban et al. | 340/33 |
| 3,784,970 | 1/1974 | Simpkin | 340/33 |
| 3,859,623 | 1/1975 | Koehler | 340/34 |
| 3,876,940 | 4/1975 | Wickford et al. | 325/64 |
| 3,949,300 | 4/1976 | Sadler | 325/31 |
| 4,013,994 | 3/1977 | Ragano et al. | 340/33 |
| 4,016,532 | 4/1977 | Rose | 340/32 |
| 4,158,190 | 6/1979 | Stefanov | 340/32 |
| 4,209,769 | 6/1980 | Chronerberry | 340/32 |
| 4,212,085 | 7/1980 | Vaillancour et al. | 367/124 |
| 4,228,419 | 10/1980 | Anderson | 340/32 |
| 4,234,967 | 11/1980 | Henschel | 455/603 |
| 4,238,778 | 12/1980 | Ohsumi | 340/32 |
| 4,380,004 | 4/1983 | Coats et al. | 340/43 |
| 4,403,208 | 9/1983 | Hodgson et al. | 340/33 |
| 4,443,790 | 4/1984 | Bishop | 340/33 |
| 4,463,339 | 7/1984 | Frick et al. | 340/642 |
| 4,573,049 | 2/1986 | Obeck | 340/924 |
| 4,587,522 | 5/1986 | Warren | 340/902 |
| 4,704,610 | 11/1987 | Smith et al. | 340/906 |
| 4,764,978 | 8/1988 | Argo et al. | 455/1 |
| 4,775,865 * | 10/1988 | Smith et al. | 340/906 |
| 4,794,394 | 12/1988 | Halstead | 340/902 |
| 4,914,434 | 4/1990 | Morgan et al. | 340/906 |
| 4,952,931 | 8/1990 | Serageldin et al. | 340/906 |
| 5,014,052 | 5/1991 | Obeck | 340/906 |
| 5,083,125 | 1/1992 | Brown et al. | 340/906 |
| 5,126,735 | 6/1992 | Trevijano | 340/902 |
| 5,187,373 * | 2/1993 | Gregori | 250/551 |
| 5,235,329 | 8/1993 | Jackson | 340/902 |
| 5,278,553 | 1/1994 | Cornett et al. | 340/902 |

(List continued on next page.)

FOREIGN PATENT DOCUMENTS

| | | | |
|---|---|---|---|
| 405205193 A | 8/1993 | (JP) | G08G/1/087 |

*Primary Examiner*—Brent A. Swarthout
*Assistant Examiner*—Toan Pham
(74) *Attorney, Agent, or Firm*—Robert G. Leu

(57) ABSTRACT

The present invention discloses a system that allows operators of emergency vehicles to obtain graphic data regarding other emergency vehicles that may pose threats of collision. Automatic signaling takes place between emergency vehicles within range of each other to transmit directional data regarding the direction of travel of each emergency vehicle. This data is correlated to derive directional vectors relative to each other. These vectors are displayed so that the operator can quickly determine the direction of other vehicles with respect to his own. The system includes equipment for preempting traffic signals by selected emergency vehicles, and for informing other emergency vehicles that a traffic signal has been preempted.

20 Claims, 7 Drawing Sheets

U.S. PATENT DOCUMENTS

| | | | | |
|---|---|---|---|---|
| 5,289,181 | | 2/1994 | Watanabe et al. | 340/902 |
| 5,303,259 | | 4/1994 | Loveall | 340/902 |
| 5,307,060 | * | 4/1994 | Prevulsky et al. | 340/902 |
| 5,345,232 | * | 9/1994 | Robertson | 340/906 |
| 5,495,243 | * | 2/1996 | McKenna | 340/902 |
| 5,572,201 | * | 11/1996 | Graham et al. | 340/902 |
| 5,574,469 | * | 11/1996 | Hsu | 342/455 |
| 5,620,155 | | 4/1997 | Michalek | 246/121 |
| 5,739,767 | * | 4/1998 | Carr | 340/902 |
| 5,889,475 | * | 3/1999 | Klosinski et al. | 340/902 |
| 5,926,112 | * | 7/1999 | Hartzell | 340/902 |
| 5,926,113 | * | 7/1999 | Jones et al. | 340/906 |
| 5,955,968 | * | 9/1999 | Bentrott et al. | 340/906 |
| 5,977,883 | * | 11/1999 | Leonard et al. | 340/906 |
| 6,011,492 | * | 1/2000 | Garesche | 340/904 |
| 6,087,961 | * | 7/2000 | Markow | 340/902 |
| 6,160,493 | * | 12/2000 | Smith | 340/902 |

* cited by examiner

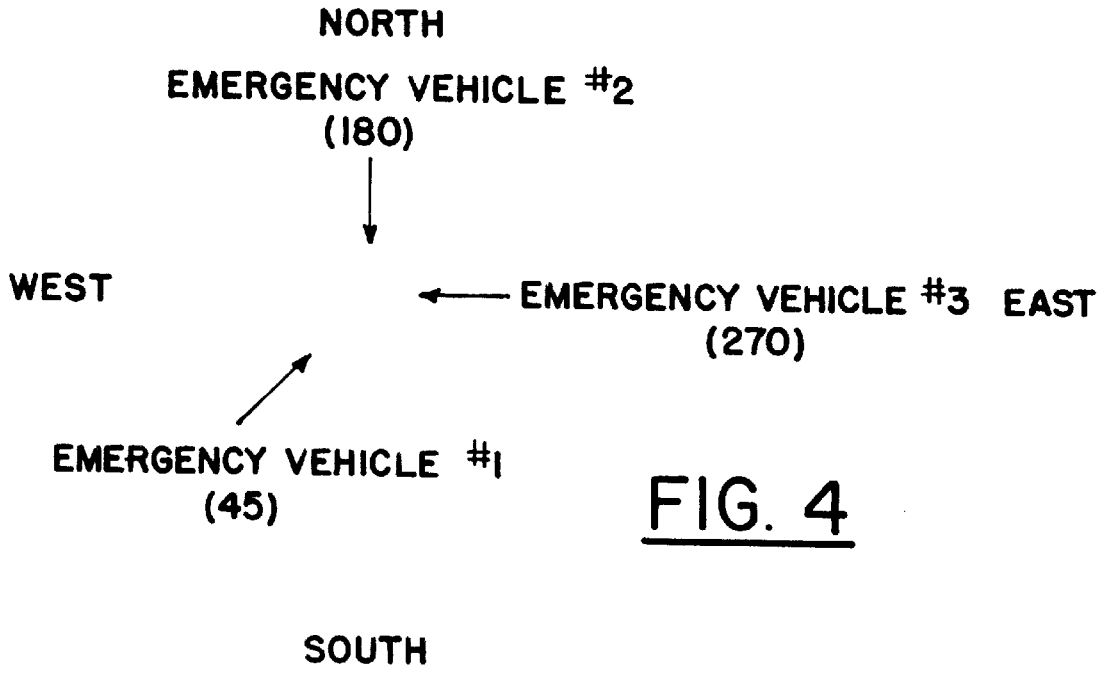
FIG. 4
FIG. 5
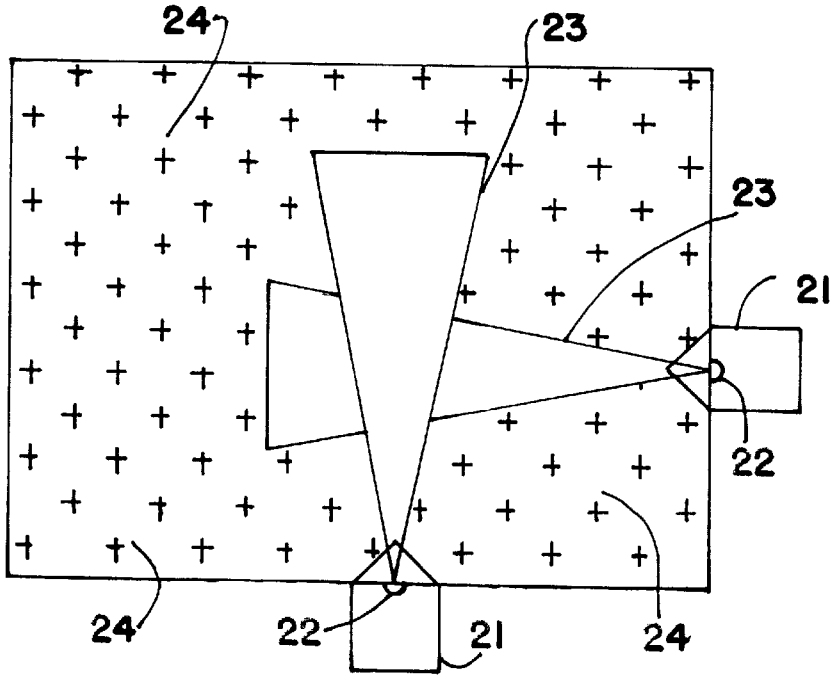

EMERGENCY VEHICLE TRAFFIC SIGNAL PRE-EMPTION AND COLLISION AVOIDANCE SYSTEM

FIELD OF THE INVENTION

The present invention relates generally to emergency vehicle warning and coordination systems. In particular, the present invention is directed to a system for conveying information among emergency vehicles, and for preempting control of traffic signals in the range of certain emergency vehicles.

BACKGROUND ART

Emergency vehicles, such as fire-fighting engines, ambulances and police cars, generally have the need to cross or pass intersections under the control of traffic signals. This must be accomplished in the least amount of time possible so that the function of an emergency vehicle can be successfully fulfilled. It is generally understood that the more quickly an emergency vehicle can reach the scene of an emergency, the greater are the chances that the victims involved can be helped or successfully treated.

Since the earliest times, emergency vehicles approaching intersections have depended upon sirens, horns, bells or other types of audible and/or visible warning devices to alert other people in the intersection. This has not always proven to be a successful technique, even though it is still the standard mode of operation for emergency vehicles today. Unfortunately, accidents involving emergency vehicles often occur at intersections due to confusion, impaired hearing, inattention, noise conditions or overly-aggressive drivers seeking to clear the intersection before the arrival of the emergency vehicle. Other factors are the speed of the emergency vehicle and the resulting inability of others to react to it, distractions affecting the driver of the emergency vehicle, and the like. Further problems are caused when multiple emergency vehicles are approaching the same intersection. This situation is further complicated when the sirens and other signals from multiple emergency vehicles can be heard within the same area—a combination confusing to both pedestrians and other motorists, as well as the operators of both emergency vehicles. In many cases, due to siren noise and the intensity of focused driving at high speeds through congested areas, emergency vehicle operators are often not aware of other such vehicles in the same area.

There have been many systems proposed to address these problems. One such system is disclosed in U.S. Pat. Nos. 3,550,078 (re-issue no. 228,100, re-issued Aug. 6, 1974 to Long). The system disclosed provides the ability of an emergency vehicle with the ability to remotely control traffic light signals so as to provide signals that will allow the emergency vehicle to easily pass through intersections without undue delays. Unfortunately, this system does not properly alert pedestrians or other drivers at the subject intersection that the traffic light control has been preempted. Further, there appears to be no means in this system to reconcile control between competing emergency vehicles. Consequently, this system does not compensate for the inattentiveness of pedestrians or other drivers in the intersection. Nor does this system compensate for the approach of other emergency vehicles to the controlled intersection.

Part of this problem has been addressed in U.S. Pat. No. 4,704,610 to Smith et al. This patent discloses a system in which a display at the intersection indicates that preemption of the traffic signal has been carried out and that the emergency vehicle is approaching. This system also indicates whether the emergency vehicle has already passed through the intersection. The signal from the emergency vehicle is transmitted to the controller at the intersection by means of infrared radiation. Consequently, the range of the system is limited. Further, the system does not provide for reconciliation by attempts to control the intersection by two approaching emergency vehicles. Nor does this system advise the operators of emergency vehicles that other emergency vehicles may be in the same area.

Determining priority between emergency vehicles is carried out in the system disclosed by U.S. Patent No. 4,914,434 to Morgan et al. In this system a controller located at a particular intersection carries out a series of computations based upon signal analysis of competing, incoming emergency vehicles, and then selects which emergency vehicle will be given priority. Accordingly, the selected emergency vehicle is provided with a green light while any competing emergency vehicles are advised that they do not have priority through the intersection. The system also encompasses the selection of alternative routes or pathways that an emergency vehicle can take if it has been preempted from control at a particular intersection. Unfortunately, indication that an emergency vehicles control of an intersection traffic signal has been preempted often occurs after it is too late to select alternative routes. In some cases, such indication may not be noticed by the vehicle operator until the emergency vehicle is in the intersection, thereby greatly increasing the risks of accidents between emergency vehicles.

Accordingly there is a need in this technology for a system which advises emergency vehicle operators of other emergency vehicles in the area. Further, information regarding the direction of the other emergency vehicles is needed so that advanced planning can be carried out by the emergency vehicle operator to avoid collisions at intersections, as well as competition for control of traffic signals at intersections. Proper advanced warning for emergency vehicle operators would facilitate greater safety for emergency vehicle operators, pedestrians and other vehicle operators.

SUMMARY OF THE INVENTION

It is one object of the present invention to overcome the drawbacks of the conventional art, and provide safer operating conditions for emergency vehicles, as well as other vehicles and pedestrians within the area traversed by emergency vehicles.

It is another object of the present invention to avoid situations in which two emergency vehicles are competing to control the traffic signals in a single intersection.

It is another object of the present invention to give adequate advance warning to emergency vehicle operators so as to avoid conflicts at intersections.

It is an additional object of the present invention to alert emergency vehicle operators of the position and direction of travel of other emergency vehicles.

It is still another object of the present invention to provide sufficient information to emergency vehicles operators so that coordination between emergency vehicles can be achieved.

It is again a further object of the present invention to provide a system by which emergency vehicles may safely move through intersections without interference of other emergency vehicles.

It is still a further object of the present invention to provide a system by which emergency vehicles can receive only relevant information regarding other emergency vehicles.

These and other goals and objects of the present invention are facilitated by an emergency vehicle collision avoidance system including a plurality of emergency vehicles. Each of the emergency vehicles has a device for determining direction of travel of the emergency vehicle and a transceiver arranged to transmit direction signals indicative of the direction of travel of the emergency vehicle. The transceivers also are arranged to receive signals indicative of direction of travel of other emergency vehicles within range of the transceiver. Also included with each emergency vehicle is a correlating device for calculating direction vectors based upon the direction of signals of the other emergency vehicles. These direction vectors are depicted on a display so that the vehicle operator is able to determine sources of possible collisions with other emergency vehicles. Another aspect of the present invention is manifested by a method of identifying emergency vehicles.

Another aspect of the present invention is manifested by a method of operating an emergency vehicle collision avoidance system. This system includes a plurality of emergency vehicles where each emergency vehicle operates according to a method including a first step of obtaining directional data indicative of a direction of travel of the subject emergency vehicle. In the next step an emergency vehicle sends directional signals to other emergency vehicles indicative of its directional data. These directional signals are sent in a first mode of transmission. Each emergency vehicle then correlates the received directional signals to determine directional vectors based upon directional signals received. From this, relative relationships between the directional vectors are derived. These vectors are then displayed to depict the relative directions of travel of other emergency vehicles with respect to the subject emergency vehicle.

BRIEF DESCRIPTION OF THE DRAWINGS

FIG. 4 is a diagram depicting a calculation to determine relative direction of two vehicles using the present invention.

FIG. 5 is a diagram depicting electromagnetic energy transmission patterns for two vehicles using the present invention.

DETAILED DESCRIPTION OF THE PREFERRED EMBODIMENTS

Figure 1:
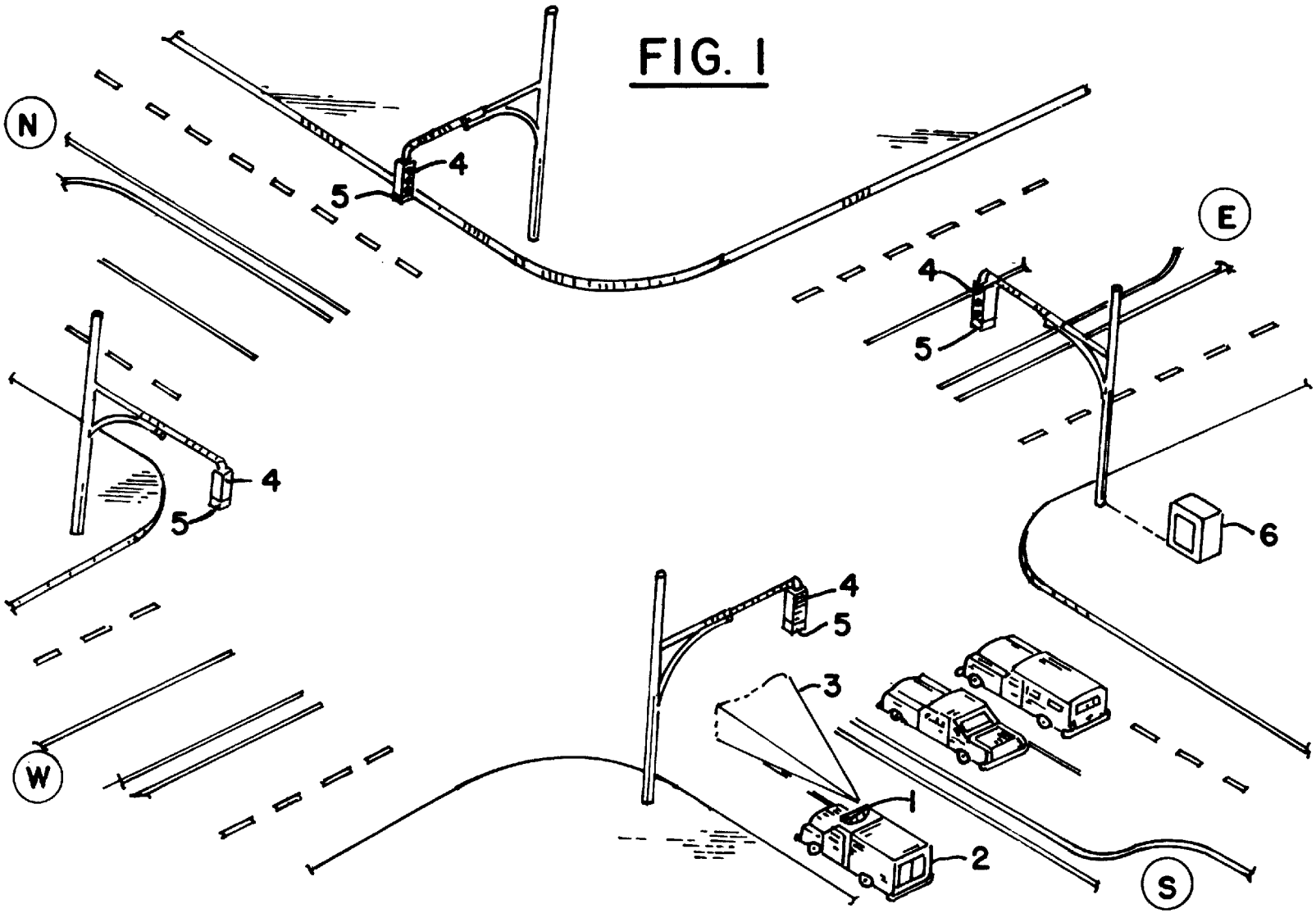
FIG. 1 is a diagram depicting the environment in which the present invention can operate.

The environment in which the present invention operates is depicted in FIG. 1. The present invention is meant to operate in an environment that includes traffic signals (4) and their controllers (5). Transmitters (1) in emergency vehicles (2) are designed to send signals to traffic signal controllers to preempt control of the traffic signals. Receiving mechanisms (1) in each of the emergency vehicles are used to provide indication of other, similarly equipped, emergency vehicles within range of the emergency vehicle transceivers.

A key factor is the use of information regarding other emergency vehicles, in particular direction vectors that can be displayed in relation to the direction vector of a particular vehicle receiving the directional information. Another key aspect of the present invention is the use of transceivers to inform emergency vehicles when control of a particular traffic signal has been preempted in favor of travel of a selected emergency vehicle. Accordingly, when the proper indication is displayed (either graphically or using flashing lights), the emergency vehicle operator knows to take suitable precautions when approaching the intersection controlled by that particular traffic signal. The equipment used to constitute the various elements of the present invention is generally well-known.

Examples of systems containing equipment that can be used to facilitate the present invention are found in: U.S. Pat. No. 4,914,434 to Morgan et al.; U.S. Pat. No. 4,212,085 to Vaillancour et al.; U.S. Pat. No. 4,228,419 to Anderson; U.S. Pat. No. 5,083,125 to Brown et al.; U.S. Pat. No. 5,014,052 to Obeck; U.S. Pat. No. 5,235,329 to Jackson; U.S. Pat. No. 5,289,181 to Watanabe et al.; U.S. Pat. No. 4,704,610 to Smith et al.; and, U.S. Pat. No. 5,620,155 to Michalek, all incorporated herein by reference.

These collected patents disclose a number of components that can be used to facilitate the present invention. However, facilitation of the present invention is not limited to the components disclosed in the subject patents, but can use any and all equivalents, as well as additional components as specified below, many of these components have not been previously used in the coordination of emergency vehicles and traffic lights.

One aspect of the system of the present invention is constituted by components directed to sending signals to a traffic signal control device (6) in order to preempt control of the traffic signal (4). This operation is carried out to allow swift passage of the emergency vehicle (2) through a particular intersection controlled by the traffic signal control device. An emergency vehicle (EV) transceiver (1) is carried onboard emergency vehicles (2) (police, fire, ambulance and the like) and, when activated, broadcasts directional data preferably using a forward-directed electromagnetic (EM) beam (3) to the traffic signal (4) equipped with a traffic signal (TS) transceiver (5). The directional information is then relayed to the traffic signal control mechanism (6), which commands the traffic signal (4) to go into a "preemptive" mode favoring a particular EV approaching the intersection. As a result of having the directional information regarding the selected emergency vehicle, the traffic signal control device can control the traffic signal so as to allow a selected emergency vehicle to pass through the intersection with as little delay as possible.

Figure 2:
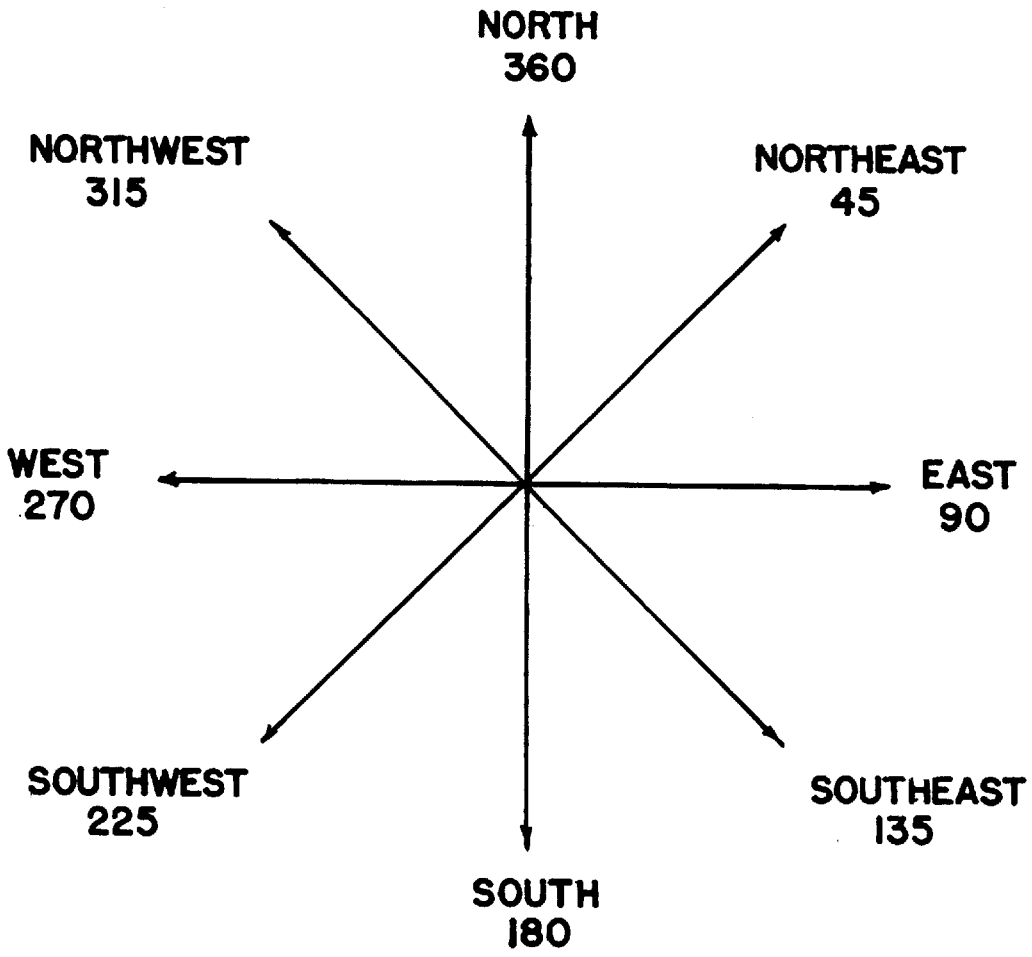
FIG. 2 is a diagram depicting the directional orientation adopted for use with the present invention FIG. 3(*a*) is a diagram depicting the control and display panel used for one embodiment the present invention.

Along with the EV transceiver (1) in each EV (2) is a compass mechanism (not shown) which provides the direction of travel of the emergency vehicle in which it is in use. The direction of travel of the emergency vehicle (see FIG. 2) is translated into a number between 1–360 (corresponding to the degrees of a circle), according to the pattern depicted in FIG. 2. For example, if the emergency vehicle is traveling due north, then the information which is included in its transmitted signal pattern (3) is the number 360. Likewise, if the vehicle is traveling due south the data is transmitted as the number 180, as depicted in FIG. 2. It should be noted that display 100 in FIGS. 3(*a*) and 3(*b*) can be provided with an overlay according to the pattern of FIG. 2 so that a vehicle operator may more easily recognize the directions at which other emergency vehicles may be approaching his own.

The compass mechanism (not shown) can be any number of different direction finding and indication devices, and is located with the transceiver (1) in each emergency vehicle (2). While a simple standard magnetic compass can be used, there may be some problems with respect to recognizing and transmitting direction vectors to other vehicles, as will be described infra. Accordingly a more comprehensive direction-finding system is preferred.

A more expensive but comprehensive alternative is the use of a global positioning system (GPS). The non-military version of this system provides sufficiently accurate location data (within ten feet) so as to allow an accurate location of a particular vehicle so equipped to be determined. Multiple readings of the GPS can be translated into a direction vector. One advantage to this system is that precise, location data for a number of emergency vehicles can be quickly and accurately determined, and circulated among the vehicles for display to vehicle operators. One aspect of the GPS system that justifies the cost is that relative locations of other emergency vehicles that can cause potential collisions can be displayed for each emergency vehicle operator. As a result, each operator is better able to identify potential trouble much more quickly, and take appropriate measures. Further, the cost for commercial GPS devices has become substantially modest so that individuals can use such devices in order to be easily located almost anywhere on the planet. The addition of GPS to the transceiver (and the controller for the transceiver as described infra) is relatively easy, and would be apparent to any individual skilled in the various uses of GPS.

Another alternative is the use of a solid state direction indicator module, as installed on a wide variety of General Motors® makes of vehicles. This module is relatively inexpensive, provides an electronic readout that is easily modified to the direction-numbering system depicted in FIG. 2, and in the more elaborate embodiments, the direction module can generate signals indicative of vehicle direction or transmission to other emergency vehicles (21), as well as traffic signal control mechanisms (6). In the alternative, standard direction signals can be taken from the directional module, transmitted to other vehicles, and then converted to the system depicted in FIG. 2 for display within each of the receiving emergency vehicles (2).

As the emergency vehicle (2) approaches the traffic signal (4), the TS transceiver (5) receives the information regarding the direction of travel of the emergency vehicle (2) via its EM transmission (3), broadcast by the EV transceiver (1). The information received by the TS transceiver (5) regarding the emergency vehicles direction of travel is relayed to the traffic signal control mechanism (6) which them preempts the traffic signal (4) in the appropriate fashion, to allow the EV to pass quickly through the intersection controlled by the TS (4).

Figure 3A:
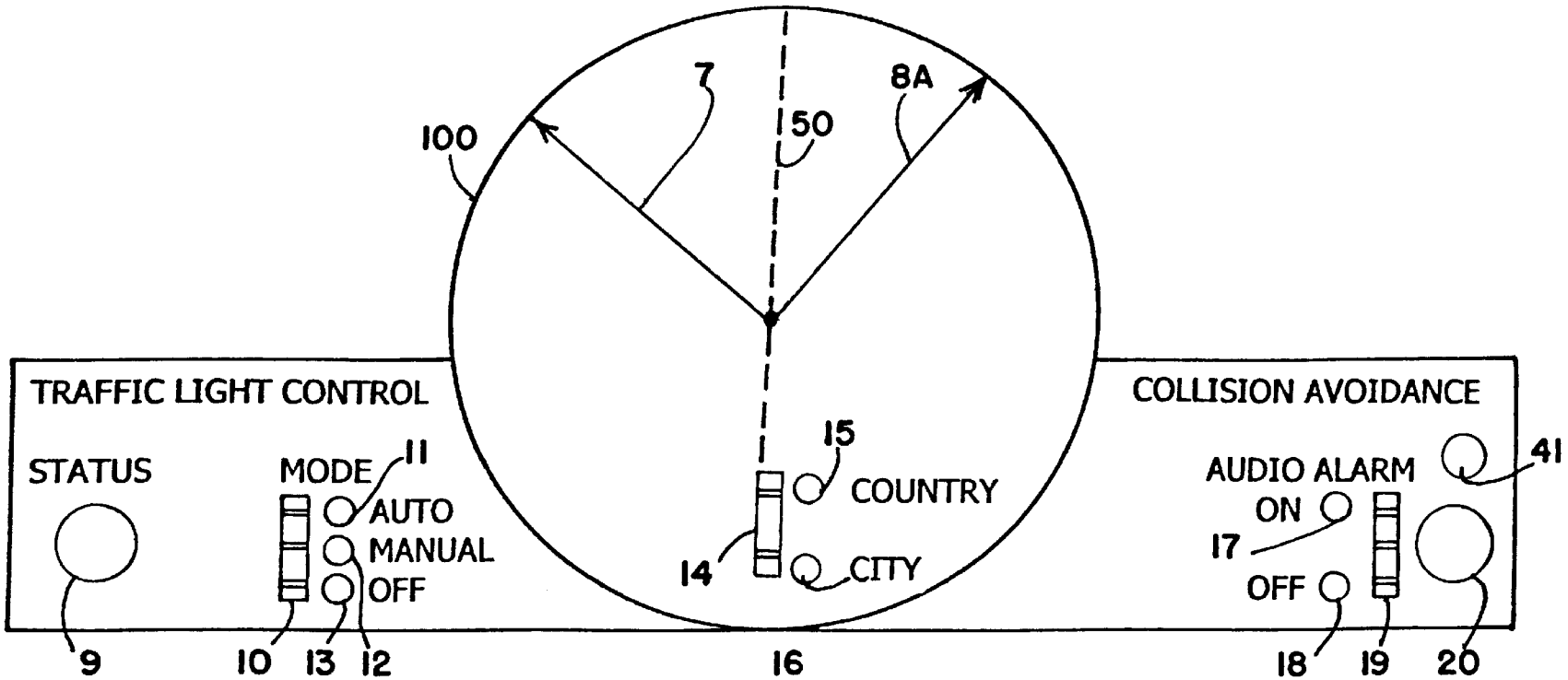
FIG. 3(*b*) is a diagram depicting the control display panel used in another embodiment of the present invention, employing GPS data for the display of absolute direction data.
Figure 3B:
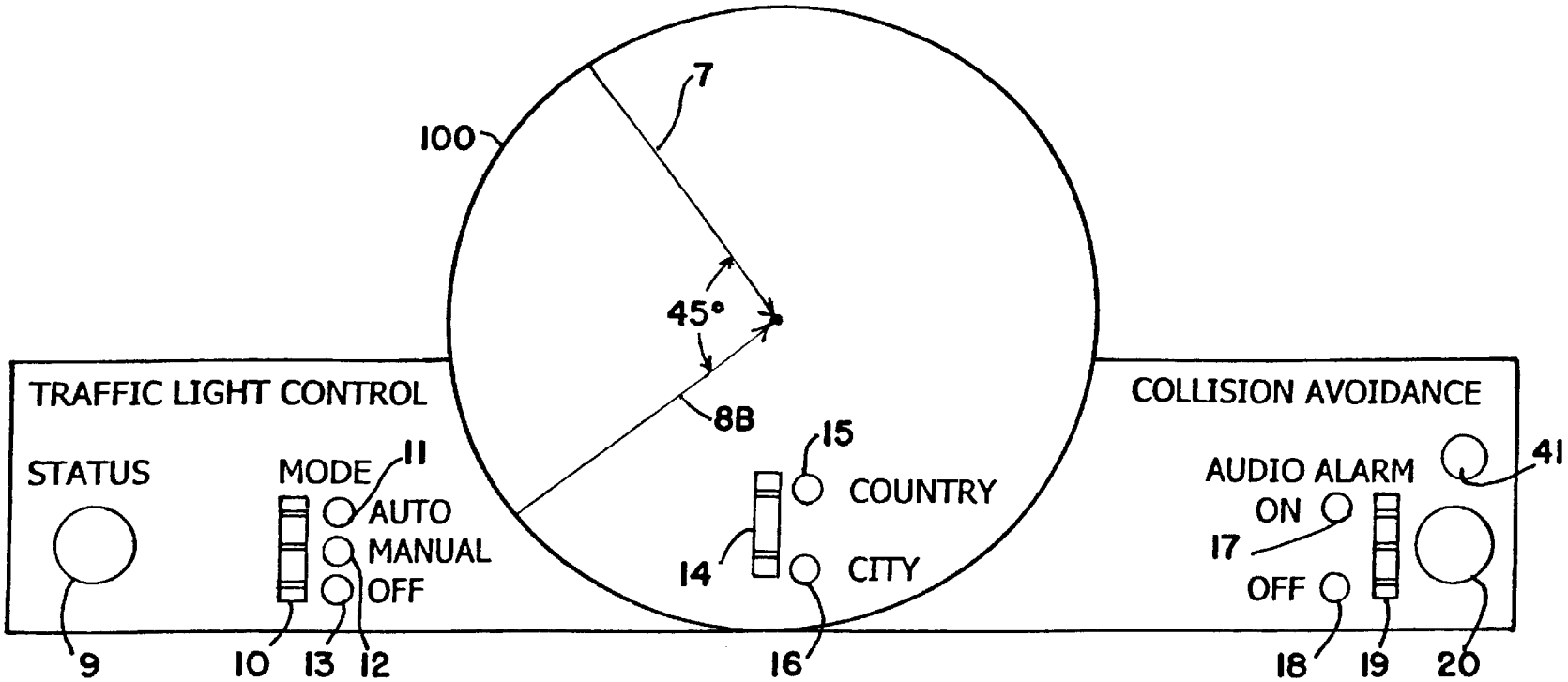

In situations where two or more emergency vehicles (2) which are equipped with the inventive system approach the same traffic signal (4) from different directions as depicted in FIGS. 4 and 5, preemptive control of the traffic signal (4) is relegated in favor of the emergency vehicle that is closest to the traffic signal, as determined by signal strength (or any other appropriate method). A proper determination can usually be made since all EV transceivers (1) broadcast with the same power output. Another collision avoidance feature of the EV system (as depicted in FIGS. 3(*a*) and 3(*b*)) is activated. In particular a display 100 on the face of the EV control panel will alert the driver of the emergency vehicle (2) with an arrow pointing in the direction of the impending collision. Also, an auidble collision alarm will sound if not detected. The manner in which the angle of impending collision is determined by the inventive system is described below in conjunction with FIG. 4.

FIG. 4 depicts the relative direction of travel of three different emergency vehicles, presumed to be using the system of the present invention. The key attribute of the present invention is to depict (in display 100 of FIGS. 3(*a*) and 3(*b*)) the relative directions of travel of multiple emergency vehicles on a potential collision course. With this information, the angle of an impending collision can be calculated and displayed as depicted in FIGS. 3(*a*) and 3(*b*).

If the value of "Y" (in FIG. 4) represent a number between 1 and 360, the value 45 corresponds to the direction of travel of the selected emergency vehicle in #1 (at which the reading will be displayed) in FIG. 4. Also, the value of "X" represents a number between 1 and 360 that corresponds to the direction of travel of a second emergency vehicle, #2 having a value of 180. Accordingly, the angle of impending collision from emergency vehicle #1's frame reference is calculated and presented as "Z" using Equation #1 in FIG. 4:

$$X-Y+180=Z$$

where Z represents the number between 1 and 360 corresponding to the direction of the impending collision. This is shown by arrow (7) in FIG. 3(*a*). When Equation #1 is operated on the aforementioned values, the result is a value of 115°. Referring to FIG. 2 (which can be used for an overlay (50) for display 100), the emergency vehicle operator knows that there is the possibility of impending collision at a 45° angle from the northwest. Vector 7 in FIG. 3(*a*) represents the direction that the vehicle operator should look to detect a collision with emergency vehicle #2. This display is used on the assumption that the receiving emergency vehicle (1) is always oriented to face due 60° north (either 0° or 360°).

Overlay 50 on display 100 of FIG. 3(*a*) is used to always indicate to the emergency vehicle operator the direction in which his own vehicle is oriented. While this orientation does not provide the absolute direction of any of the vehicles, the relative directions of the emergency vehicles 2 and 3 are displayed with respect to the constant orientation of emergency vehicle #1. Overlay 50 which reminds the vehicle operator of the alignment of his own vehicle relative to other vehicles can be provided by the pattern depicted in FIG. 2. This embodiment of the present invention is relatively simple, being confined to depicting only the relative directions between emergency vehicles.

Another example of the mathematical calculation using Equation #1 pertains to the vehicle #3 in FIG. 4. In this example emergency vehicle #1 is traveling in a true northeasterly direction. Accordingly, its EV transceiver is broadcasting the number 45. To calculate the value of Z for the impending collision with emergency vehicle #3, then Y=45 (emergency vehicle #1's frame of reference). If emergency vehicle #3 is traveling due west, then its transceiver sends a signal containing with the number value 270 so that X=270 in Equation #1. If X−Y+180=Z, then (270)−(45)+180=Z, so that Z=405. Since 405 is greater than 360, it is necessary to subtract these two values to derive a value of 45. The angle of the impending collision between emergency vehicles #1 and #3 (from emergency vehicle #1's frame of reference) can be displayed as a 45° vector from the northeast. The collision avoidance system (CAS) display 100 would have a reading of 45 corresponds to the angle of impending collision between emergency vehicle #1 and #3, as seen from #1's frame of reference or frontally from the right at a 45-degree angle (Vector 8A in FIG. 3(*b*)). This is the direction in which the driver of emergency vehicle #1 should look to see the impending collision and have ample time to avoid it.

An alternative arrangement, that uses absolute directional data from a source such as a GPS and, may be more convenient for drivers, is found in the display 100 of FIG. 3(*b*). In this display, the two vectors (7), (8*b*) represent the direction of vehicle #2, and vehicle #1, respectively. The two vectors may be designated differently (such as by different colors, patterns and the like) so that any emergency vehicle operator can easily identify his own vehicle on the display. The display provides the direction at which the receiving emergency vehicle (#1) is headed and the vector at which a possible collision may occur with vehicle #2. As an added feature, the calculated angle between the two can be added to the display, thereby making the pending situation clear to the emergency vehicle operator in the shortest amount of time. The orientation of the respective vectors can be done in any reasonable fashion that facilitates easy recognition by the emergency vehicle operator. Accordingly, any variation in the orientation of the respective vehicle vectors and the angles between them fall within the concept of the present invention.

However for Equation #1 to work in all possible,real-world scenarios a final calculation will be required to bring the numerical value of Z into the acceptable tolerance range of a number between 1 and 360 when the calculated value of Z in above equation becomes greater than 360 or less than or equal to zero, In the instance where Z is greater than 360, the final value of Z is determined by subtracting 360. In the instance where Z is less than or equal to zero, the final value of Z is determined by adding 360.

To calculate the angle of the impending collision with emergency vehicle #1 from emergency vehicle #3's frame of reference, the value of X now becomes 45 while the value of Y becomes 270. Therefore it follows if $X-Y+180=Z$, then $(45)-(270)+180=Z$. This yields an initial value for Z of −45. Since $-45 \leqq 0$, it is necessary to add 360 to determine the final value of Z as $(-45)+360=315$. This corresponds to a collision with emergency vehicle #1 from emergency vehicle #3's frame of reference impending frontally from the left at a 45-degree angle. Of course, the display seen in emergency vehicle #3 will differ from that seen in emergency vehicle #1, as will the display in emergency vehicle #2. As previously indicated, the orientation of the receiving vehicle (emergency vehicle #1 for purposes of the aforementioned examples) can have any orientation that will facilitate quick comprehension by the emergency vehicle operator. Consequently, the only required aspect of display 100 is that the relative angles between the direction vectors (indicative of their relative headings) be clearly displayed.

In the overall hypothetical scenario pictured in FIG. 4, three emergency vehicles are approaching the same intersection. In the case where more than two emergency vehicles are approaching the same intersection, the above formula holds true, with a separate calculation being performed independently for each emergency vehicle's value of"X". Accordingly, the display 100 in FIG. 3(*b*) on board each emergency vehicle can display multiple impending collision arrows, each corresponding to the direction of approach of the other emergency vehicles from its frame of reference.

It should be noted that display 100 can be configured to show multiple approaching emergency vehicles using the present invention. Also, the display can also be configured to depict the direction of travel of the selected vehicle, as well, as indicated by arrow 8(*b*) in FIG. 3(*b*). If GPS is used, the relative locations of the vehicles can also be displayed. Using GPS data, the controller (not shown) for the transceiver in each emergency vehicle can also carry out a calculation of the distances between various emergency vehicles. This value can also be indicated on display 100.

Display 100 need not be a separate display screen as depicted in FIGS. 3(*a*) and 3(*b*). Rather, the display mechanism can be a standard "heads-up" display commonly used in aerodynamics and adopted in automobiles. The advantages of such displays are already well-known. In particular, a "heads-up" display allows a vehicle operator to use the present invention while still concentrating on the traffic in front of his own vehicle. There is no necessity for looking down at an extra display screen while driving the emergency vehicle under intense circumstances. Further, existing "heads-up" displays can be used after modification so as to limit the amount of new equipment to be added to the emergency vehicle. Further, the use of "heads-up" displays would be particularly efficacious on motorcycles, or in other situations when "hands-free" operation would be considered desirable.

It should be further noted that EV transceivers (22) (of FIG. 5) have the capability of varying the width of transmission patterns (23) and (24). A five-ten degree forward transmission pattern (23) can be used when in a crowded city environment. A 180 degree forward transmission pattern (24) is used in a low-density environment. The wide pattern (24) helps to activate a maximum of other nearby EV transceivers (22), giving ample collision avoidance warning to other similarly equipped vehicles (21) where no traffic signals are present to act as "transponders" to relay the information to them. The transmission patterns can be controlled using control switch as depicted in FIGS. 3(*a*) and 3(*b*). It should be noted that the present invention is not restricted to two different settings but can use a wide variety of different transmission patterns, as is appropriate for particular environments.

A potential problem which may occur during an emergency call is when an ambulance arrives on the scene of an accident at or near an intersection that is equipped with the present invention. It is often imperative for the operator of the ambulance to exit the vehicle as quickly as possible to begin rendering medical attention to victims immediately. If in his or her haste, the operator of the emergency vehicle neglects to deactivate the traffic signal control system, any traffic signals nearby will continue to be preempted. This situation could also preclude another emergency vehicle from properly preempting the traffic signal control in its favor as it nears the scene of the accident.

Preferably, the control system of the present invention is connected so that when the emergency light system is activated, the traffic signal preemption operation of the present invention is also activated. For safety reasons, it is customary to leave the emergency lights running when an ambulance (or other emergency vehicle) stops on an emergency call. However, the status of the traffic preemption system is generally not foremost in the mind of the emergency personnel arriving on the scene. As a result, traffic signal preemption could continue in favor of the now-halted emergency vehicle, which has arrived at the scene.

To allow the operators of said emergency vehicles to not have to "shut down" the device before exiting the vehicle, the EV transceiver (1) can also be connected to the vehicle's transmission. When the vehicle's transmission is in "park", the system's traffic signal preemption mode is automatically disengaged. The system is automatically returned to the "auto" mode (11) when the vehicle is put back into gear while the mode switch itself (1O) physically remains in the "auto" position.

Similarly, if the system is in the manual mode (12) upon arrival at the scene, the systems traffic signal preemption mode is automatically disengaged when the vehicle's transmission is in park. The system is automatically returned to the "manual" mode (12) when the vehicle is put back into gear while the mode switch itself (10) physically remains in the "manual" mode.

Figure 6:
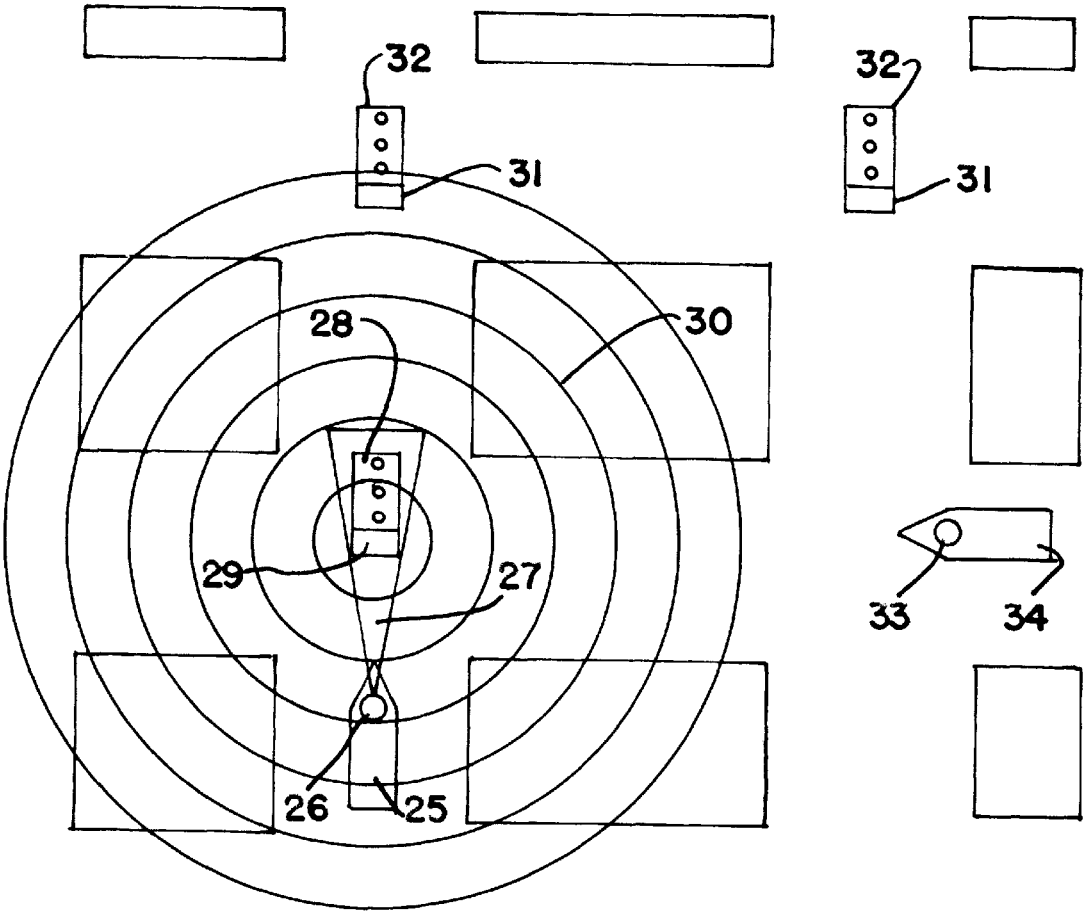
FIG. 6 is block diagram depicting relative vehicle locations and base station transmission patterns for components used as part of the present invention.

The traffic signal transceiver or "TS transceiver" (labeled (5) in FIG. 1) is affixed to the traffic signal (4). When an E.M. tranmission (3) from an EV transceiver (1) carried on board an emergency vehicle (2) reaches the TS transceiver (5), control of the traffic signal (4) is preempted in favor of EV (25). Traffic signal transceiver (5) (depicted as (29) in FIG. 6). also acts to omnidirectionally rebroadcast via transmission pattern (30) (of FIG. 6) the data received regarding the direction of travel of the subject emergency vehicle (25) to any other emergency vehicles (34) approaching the intersection.

This transmission pattern (30) rebroadcast by the TS transceiver (29) is either on a different frequency, different mode of operation or has some other distinguishable characteristic to allow other TS transceivers (31) to recognize it as being discernable from the normal broadcast pattern (27) of an EV transceiver (26).

If this were not the case, more than one TS transceiver (31) might be affected, and the corresponding traffic signals (32) inappropriately preempted. This operation could cause a "domino-like" chain reaction, with each TS transceiver (29) relaying the information on to others close enough to be within range of its broadcast. Accordingly, a TS transceiver's (29) broadcast transmission (30) must only affect other EV transceivers (33) and not other TS transceivers (3 1). However an EV transmission (27) (in FIG. 6) will affect both other EV transceivers (33) and any TS transceivers (29) and (31) within range.

Additionally, a strobe (not shown) at the base of the TS transceiver (5) in FIG. 1 is activated by the receipt of a signal beam (3) from an EV transceiver (1), thereby alerting nearby traffic of the emergency vehicle's approach. This also allows the driver of an emergency vehicle the additional visual confirmation of having acquired control of the traffic signal (4) without having to visually divert his attention from the road to the display (100) of the EV transceiver (1) in his vehicle to check the traffic signal status on the control board of FIG. 3.

A control panel and display for the present invention is depicted in FIG. 3. This arrangement is simply one example of a control and display arrangement that can be used with the present invention, and the present invention is not at all limited thereby. Display 100 is shown as having two arrows. Arrow 8 (at 45°) depicts the original direction of the subject vehicle. Arrow 7 is shown as being at a 45° angle to arrow 8, and indicates the travel direction of another EV for a potential collision with vehicle 1 of FIG. 4. Display 100 may be arranged to show any number of arrows indicative of vehicles using the system of the present invention within range of a particular receiving vehicle.

Also included in te control/display is an L.E.D. "status" indicator (9), which verifies communication link with TS transceiver by lighting the L.E.D. green, for example. If not in communication with a TS transceiver, the L.E.D. is lit red. A 3 position mode switch (10) is arranged with L.E.D. visual confirmation next to each mode position of the mode switch (10). Preferably the mode switch is constituted by a toggle switch. An L.E.D. (11) lights green when mode switch (10) is in "auto" mode. As a safety precaution the "auto" mode of the EV transceiver automatically engages the traffic light control feature only when the siren or light bar is activated on the vehicle. Even when siren and red lights are not activated, the receiving capability with audio and visual alarms remains operative.

L.E.D. (12) lights green when the mode switch (10) is in the "manual" mode. When in the "manual" mode, the traffic light control feature is constantly engaged, and both audio and visual collision avoidance features are operational. This mode may be used by an unmarked police car, for example, which desires full use of the features, but does not wish to use its siren or light bar.

L.E.D. (13) lights red when in the "off" mode. In this mode, traffic lights are not affected. Visual and audible collision alarms still remain operative, unless audio alarm toggle (19) is in the "off" position, then a visual collision alert only is available.

Broadcast beam width can be adjusted by two-position mode switch (14), which is accompanied by L.E.D. visual confirmation next to each position of the toggle switch (14). It should be noted that a two-positioned toggle switch is not necessary for the operation of the present invention. Rather, the use of this switch to select between high and low density areas is merely one variation that can be used in the present invention. A wide variety of transmission beam patterns can be used with the present invention. Accordingly, appropriate controls can be used to select any number of transmission patterns that may be desired.

The L.E.D. (15) lights green when toggle switch (14) is in the "country" or wide dispersement position. The broadcast beam (depicted in FIG. 5) radiates in a 180 degree pattern (24). This position is used in rural areas, for example, where no similarly equipped traffic signals are within range. This allows for direct "vehicle to vehicle" transmission of collision avoidance information without an appropriately equipped traffic signal within a range to rebroadcast the information to other EV transceivers.

The L.E.D. (16) lights green when toggle switch (14) is in the "city" or narrow dispersment position. The broadcast beam (23) of FIG. 5 radiates forward at a 10 degree angle. This position is used when the emergency vehicle is likely to encounter traffic signals equipped with the present invention. The narrow broadcast pattern (23) of between 5–10°, helps to limit the number of conflicting signals received by each traffic signal (4) within crowded urban environments.

The L.E.D. (17) lights green and indicates that the audio alarm toggle switch (19) is in the "on" position. The L.E.D. (18) lights red and indicates that audio alarm toggle switch (19) is in the "off" position. An audio alarm, two-position toggle switch (19) allows the operator to manually "silence" the intrusive audible collision alarm. The "on" and "off" positions of this switch are visually confirmed by green "on" L.E.D. (17) and red "off" L.E.D. (18).

Audio alarm volume knob (20) controls a rheostat (or other appropriate electronic control) that allows the vehicle operator to adjust the volume of the intrusive audible collision alarm. A press to test button (41) is located at the center of the circular portion of the display 100, depicting arrows 7,8.

Figure 7:
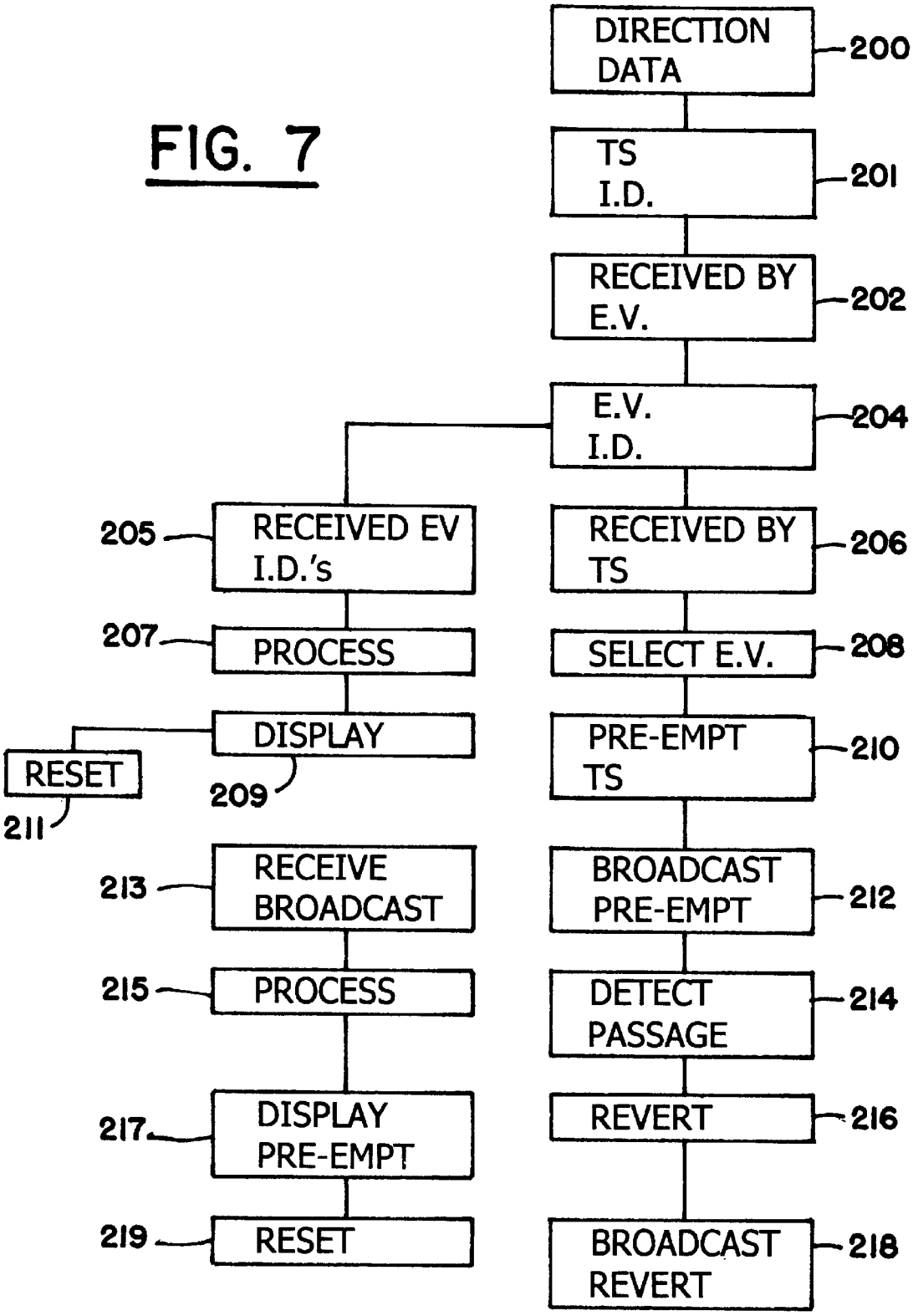
FIG. 7 is a flow diagram depicting comprehensive operation of the present invention including a number of auxiliary functions that can be included with the present invention.

FIG. 7 is a flow diagram depicting the comprehensive operation of a system encompassing a plurality of embodiments of the present invention. However, other embodiments of the present invention beyond the scope of the FIG. 7 system are also possible. It should be noted that the system, which operation is depicted in FIG. 7 also extends far beyond the most basic embodiment of the present invention, and admits to many variations and alternatives. Some of these are described below.

At step 200 the basic operation of obtaining direction of travel data is carried out. This can be done in a number of different ways well known to those skilled in this technology. A variety of different techniques can be used, including: gyroscopes; electronic detection of the position of magnetic compasses; radio triangulation; and, the use of global positioning systems (GPS). In the most advanced embodiment of the present invention the use of GPS is preferred.

A plurality of emergency vehicles (2) are used in the system of the invention, and each derives directional information regarding its movements from one of the aforementioned methods of obtaining directional data. This directional information is translated to the orientation depicted in FIG. 2. In this manner, each emergency vehicle throughout the inventive system uses common orientation so that a common set of directions can be provided for comparison of the direction of travel of each of the vehicles. This translation to the orientation of FIG. 2 is easily accomplished by the microprocessor control of any of the aforementioned directional data systems. Accordingly, the translation of orientation can be carried out by the controller or microprocessor that controls the display (100). Such manipulation of display data is well-known to those in the display technology. Accordingly, further elaboration on the translation of directional data from standard systems to FIG. 2 orientation is not necessary for an understanding of the present invention.

While step 200 is absolutely necessary for the operation of the present invention, step 201 is not. In this step, each of the traffic signals (4) (in FIG. 1) sends out data regarding its location (as translated to the FIG. 2 orientation of the present invention). Along with the location information, the traffic signal identity data can also be sent. This later type of information is helpful when dealing in highly congested areas where the traffic signal transceivers (5) are arranged to send a variety of different acknowledgment and informative signals as to be explained infra.

The traffic signal for transceivers (5) are preferably controlled by a traffic signal control device 6. This device can control the operation of a plurality of traffic signals, for one or a plurality of intersections. The control device (6) also controls the transceivers to operate in a manner so that the preprogrammed location data of all traffic signals under the control device control are transmitted as indicated at step 201. The control device will also be used to control other operations of the traffic signal transceivers (5), as is explained infra.

In step 202 the traffic signal location information is received by any emergency vehicle (2) within range of the traffic signal transceiver (5). Preferably, the location information of the traffic signal location has already been translated into the orientation of FIG. 2 so that the location information can be fed directly to display 100 (as depicted in FIG. 3). For the sake of easy recognition, display 100 can be labeled to reflect the direction orientation of FIG. 2. Further, while the basic invention requires only that display 100 depict relative directions of travel of other emergency vehicles (2), the display can also be programmed to depict the location of traffic signals (4), the changing positions of other emergency vehicles (2), and the position as well as direction of travel of the emergency vehicle in which the particular display is mounted.

All of this is facilitated through the use of GPS. However, use of exact position location for either the traffic signals (4) or all emergency vehicles (2), is not required for the operation of the present invention. Rather, only the use of direction vectors (such as 7,8 in FIG. 3) is required for the operation of the most basic form of the present invention. Accordingly, step 201 and 202 are not necessary for the operation of the basic invention but merely constitute additional steps in a more complex variation of the present invention.

Step 204 is a key part of all the variations of the present invention. Each of the emergency vehicles (2) transmits its identification code and directional information so as to be received by traffic signals (4) that are within the range (step 206) and by other emergency vehicles (2) that are within range (step 205). Preferably, transmission of the emergency vehicle (2) identity code receives that of the directional information so that the microprocessors controlling other emergency vehicle transceivers and traffic signal transceivers can take appropriate action in processing this data (at steps 207 and 208, respectively).

A single frequency and/or mode of transmission is preferably used by the emergency vehicles (2) for transmitting directional and I.D. data. Any type of electromagnetic radiation or any type of wave configuration, modulation, encoding and/or pulsing can be used to carry out this aspect of the present invention. Likewise, digital transmissions of various types, such as those used to exchange handshake codes in cellular telephone systems, can also be used. However, because of the limited amount of information that is to be sent, highly complex forms of communication (such as cellular digital packet data) communications will not be necessary to carry out the operation of the present invention.

The power level, mode of transmission and frequency will all be constrained by the system configuration, including the number of traffic lights within a particular area of a particular size, the traffic density, expected number of emergency vehicles equipped with the present invention and existing traffic coordination schemes. Accordingly, much of the transmission techniques available will be constrained by existing traffic configurations. Further, the FCC imposes other constraints, as do municipalities that already have electronically controlled traffic signals. Thus, it is most likely that a simple frequency modulation (FM) signal containing an emergency vehicle (2) identity and subsequent direction information will be preferable for most embodiments of the present invention. The range (and appropriate power levels) will most likely be between ¼ mile and 1 mile, the same as that for cellular telephones in crowded municipal areas.

Further, in crowded municipal areas the aforementioned narrow (?) transmission patterns (3) (in FIG. 1) will be used. While a 10° radiation pattern has been previously suggested, it should be understood that the transmission pattern may be varied over a wide range, from approximately 5° to 360°. The transmission pattern will be determined by the system operator, based upon existing traffic configurations and density. Likewise the range of the transmission (and it's accompanying power level) will also be determined to some extent by the density of traffic and traffic signals, as well as the general street configuration. As previously stated, the additional constraints of FCC rules and municipal ordinance rules will also be applied. The system of the present invention is sufficiently flexible to be adapted to almost any traffic pattern or configuration in a wide range of environments while still maintaining the basic components that distinguish it from the conventional technology.

A key aspect of the present invention is the reception by other emergency vehicles (2) of the identity codes and directional data of any emergency vehicle within range and equipped with the present invention. This data is processed (step 207) in a manner well-known in the display art so that a vector (such as 7,8 in FIG. 3) is generated on display (100). This is done for every emergency vehicle in range so that the number of vectors are generated by display (100) if other emergency vehicles are in range.

The processing carried out in step 207 can easily be supplemented by the generation of a vector representing the travel of the emergency vehicle in which the display 100 is contained. While this additional feature is not necessary for the operation of the present invention, it can greatly help the vehicle operator easily ascertain where his vehicle is with respect to the vector representing other vehicles. As part of the process carried out at step 207 the directional information from each of the other emergency vehicles (2) is compared to that of the emergency vehicle receiving the data, and the operation of Equation #1 (in FIG. 4) is carried out to provide the relative angles between direction of movement of the receiving emergency vehicle and any other emergency vehicles within its range.

The display of relative directional vectors to that of the receiving emergency vehicle constitutes the key component for collision avoidance. This process is simplified through the use of Equation #1 in the system emergency vehicle. The calculations using Equation #1 are carried out by any number of system controllers that are suitably programmed for arthematic computation. Such controllers are preferably constituted by the controllers used to control cellular telephones and similar transceivers. However, more powerful controllers are generally used in the control of displays, such as (100). The programming necessary to carry out all of the aforementioned processes are well within the skill of those programming microprocessors and similar equipment, and need no further elaboration for purposes of understanding the present invention.

Another ancillary feature of the present invention is the additional programming of the controller that handles the emergency vehicle display and transceivers so that the display is immediately cleared of any vehicles that are behind the path of travel of the emergency vehicle receiving the data. The automatic reset of the display is carried out at step 211, and can be facilitated in a number of different ways. The simplest and least expensive way is through the use of forward-looking narrow-beam transmission patterns for each of the emergency vehicles. Once vehicles having such transmission patterns pass each other, transmissions can no longer be detected by those vehicles. Accordingly, indications of such vehicles will be removed from the display. However, narrow-beamed transmission patterns are not always used in the operation of the present invention. Accordingly, other techniques must be used.

One variation is the use of signal strength calculations. The controller of the display and transceiver in emergency vehicles can be programmed so that signals failing to maintain predetermined parameters will cause the controller to immediately wipe any indication corresponding to these emergency vehicles from display. More complex programming can be used to carry out algorithms that allow tracking of emergency vehicles running parallel to the receiving emergency vehicle, as well as those that have passed behind the receiving emergency vehicle. Selection of the operating parameters as well as the algorithms for determining elimination of directional display vectors includes techniques found in the cellular telephone systems. Any number of these techniques can be used to effect reset step 211.

An ancillary, but very useful, component of the present invention is the preemption of traffic signals to favor the movement of emergency vehicle 2 through a particular traffic signal with a minimum of wasted time. At step 206 the identity and directional information of any emergency vehicles (2) within range of a particular traffic signal (4) is received. The signals from all the emergency vehicles are all presumed to be requests for preemption of traffic signal control so as to favor a particular emergency vehicle passing quickly through the intersection controlled by the traffic signal.

To select from a number of emergency vehicles (2), a selection process at step 208 is carried out. Preferably this selection is based upon received signal strength, where the emergency vehicle (2) having the strongest signal strength as received by the traffic signal (4), is given priority by the traffic signal control device (6). This operation, of necessity, must be automatic and relatively simple. In particular, the traffic signal is controlled to allow the selected emergency vehicle (2) to pass through the intersection without being stopped or slowed by a red light.

In one embodiment of the present invention the selection process is carried out on the basis of selecting between signal strengths of a plurality of emergency vehicle (2) signals, choosing the strongest. However, other parameters can be used to select the most appropriate emergency vehicle for preemption of traffic signal control.

Preemption of traffic signal control is carried out at step 210, overriding the normal traffic light sequence as controlled by traffic signal control device 6. Once the normal sequence has been preempted, traffic signal (4) is controlled so that passage through the intersection controlled by the traffic signal is facilitated for emergency vehicle (2) (the selected emergency vehicle). In order to accomplish proper control of the traffic signal (4) so that the selected emergency vehicle can move through the subject intersection by virtue of a green light, it is necessary that the traffic signal controller be capable of identifying the direction of travel of the selected emergency vehicle. The traffic signal controller can be the normal control device (6) or an additional controller preferably included as transceiver (5). In either case the function of this controller must encompass the identification and travel vector of the selected emergency vehicle.

Upon preempting control of the traffic signal (4) in favor of the selected emergency vehicle (2), the transceiver (5) at the traffic signal begins to broadcast a signal indicative of the preemption by the selected emergency vehicle (step 212). This signal is preferably broadcast in a 360° radiation pattern, and uses a second frequency and/or transmission mode from that originally used by the emergency vehicles when transmitting their identification and direction signals at step 204. This second frequency and/or transmission mode is also different from that used when the locations of the traffic signals are broadcast at step 201. The broadcast generated at step 212 contains the identification of the selected emergency vehicle (2). The broadcast signal identifying the selected emergency vehicle (2) is received by the other emergency vehicles (step 213).

At step 215 the data broadcast at step 212 is processed for display. Preferably, such a display would modify the existing display vector for the selected E.V. to indicate that this particular emergency vehicle had priority, and that the subject traffic signal would be controlled so as to allow the selected emergency vehicle to move easily through the intersection controlled by the traffic signal. The modification to the display can be done in any appropriate manner, such as changing the color of the display vector corresponding to the selected emergency vehicle, or by intermittent display (flashing) of the vector corresponding to the selected emergency vehicle.

The radical change in display (step 217) would indicate to the operators of the non-selected emergency vehicles, as well as the operator of the selected emergency vehicle that a particular emergency vehicle had preempted the control of the traffic signal so that the light would be green in favor of the selected emergency vehicle. It is important that a clear indication be given to all emergency vehicle operators in range that a particular emergency vehicle has been given priority through the intersection controlled by the preempted traffic signal. This can be done, as previously indicated, by a change in the configuration of display 100 (FIG. 3). In the alternative, flashing lights on the control panel (in FIG. 3) can also be used to indicate preemption status to emergency vehicle operators, as described supra.

At step 219, a reset operation is carried out in each emergency vehicle once it has passed a displayed indication of a particular traffic signal. As a result, all indication of the passed traffic signal is removed from the display 100. The benefits of using this technique, while not absolutely necessary to the operation of the present invention, are that the display is clear of clutter as quickly as appropriate, and that the vehicle operator is provided with only relevant data. The reset operation as step 219 does this. The means for determining that emergency vehicle vectors or traffic signals are no longer relevant to a particular emergency vehicle would be contained in the standard control circuitry normally used for cellular telephone systems. The decision to delete part of a display could be handled in the same manner as used by a cellular equipment when determining which base station should be selected. While this is normally done on the basis of received signal strength (at the cellular mobile unit) there are a number of different techniques and algorithms that can be used to select the most appropriate base station. These same techniques can be applied to determine when a traffic signal is no longer relevant or when the direction vectors of other emergency vehicles are no longer relevant to a particular emergency vehicle. As previously indicated, the use of tight directional transmission patterns also facilitates this decision making process by removing transmission patterns of irrelevant emergency vehicles from the range of other emergency vehicles and traffic signals.

A similar process can be carried out at step 214, where determination is made at the preempted traffic signal that the selected emergency vehicle has passed through the intersection. There are a number of techniques that can be used, including the aforementioned techniques used in cellular communications. Once passage of the selected emergency vehicle through the intersection controlled by the preempted traffic signal has occurred, it is necessary that preemption ends immediately. At this point, control of the traffic signal reverts back to the traffic signal control device, and the process is ready to begin again. The process would begin again at step 204 or 201, depending upon the features and capabilities programmed into the system. At this point, the traffic signal would once again be susceptible to preemption by other approaching emergency vehicles in the same manner that the first selected emergency vehicle obtained preemption of the traffic signal.

An extra feature that can be added to the system of the present invention is the operation of step 218. At this point, the traffic signal transceiver 5 broadcasts the signal indicative that the original preemption by the now departed selected emergency vehicle has been revoked, and that the system for that traffic signal has now reverted to its initial state. This signal can be broadcast on the same frequency and/or transmission as the broadcast announcing the original preemption. In contrast to the identification of the original preempting emergency vehicle, the reversion signal can remain the same for each reversion. In this manner, the signaling protocols for the present invention remain as simple as possible. The flexibility in the various signal-handling techniques used to facilitate the present invention is provided by techniques currently used in the cellular telephone art. In particular, the selection of the most appropriate emergency vehicle to preempt normal traffic signal control can utilize all the techniques used in cellular telephone systems for selecting between the most appropriate base stations to be used. Further, various location techniques used by both cellular telephone systems and in the more-precise global positioning systems can be used to provide a display of not only direction vectors for moving vehicles but also precise locations of those vehicles with respect to each other and the various traffic signals equipped with the present invention. As a result, the present invention is sufficiently flexible to operate in virtually any type of traffic environment.

While a number of embodiments of the present invention have been described by way of example, the present invention is not limited thereto. Rather, the present invention should be construed to include any and all variations, permutations, modifications, adjustments and embodiments which would occur to one skilled in this technology, once having been taught the present invention. Accordingly, the present invention is to be interpreted as being limited only by the following claims.

We claim:

1. An emergency vehicle collision avoidance system including a plurality of emergency vehicles, each emergency vehicle comprising:

(a) means for determining direction of travel of said emergency vehicle;

(b) an emergency vehicle transceiver arranged to transmit direction signals indicative of said direction of vehicle travel, and receiving direction signals indicative of direction of travel of other emergency vehicles;

(c) correlating means for calculating relative direction vectors based upon said direction signals indicative of vehicle travel of said other emergency vehicles; and, (d) a graphical display arranged to depict a relative arrangement of said direction vectors.

2. The emergency vehicle collision avoidance system of claim 1, wherein said correlating means comprise means for calculating a direction vector for said emergency vehicle relative to said vectors of travel of said other emergency vehicles so that said direction vector of said emergency vehicle is depicted by said graphical display.

3. The emergency vehicle collision avoidance system of claim 2, wherein said means for determining direction of travel of said emergency vehicle also comprise means for determining location of said emergency vehicle.

4. The emergency vehicle collision avoidance system of claim 3, wherein said transceiver is arranged to transmit emergency vehicle location data along with said signal indicative of said direction of emergency vehicle travel.

5. The emergency vehicle collision avoidance system of claim 4, wherein said means for determining direction of travel and said means for determining location are constituted by a global positioning system (GPS).

6. The emergency vehicle collision system of claim 5, wherein said transceiver is arranged to operate in a first mode to transmit and receive said direction signals indicative of direction of travel of said other emergency vehicles.

7. The emergency vehicle collision avoidance system of claim 6, wherein said emergency vehicle transceiver comprises means to adjust transmission patterns from 10° to 180°.

8. The emergency vehicle collision system of claim 7, wherein said emergency vehicle transceiver comprises means for operating in a second mode of signal transmission.

9. The emergency vehicle collision avoidance system of claim 8, further including a traffic signal, said traffic signal comprising:

(i) a traffic signal transceiver arranged to operate in said first and said second modes of operation; and, (ii) a controller arranged to operate said traffic signal based upon signals received from said emergency vehicle.

10. The emergency vehicle collision avoidance system of claim 9, wherein said controller comprises means for selecting among incoming directional signals from a plurality of said emergency vehicles.

11. The emergency vehicle collision avoidance system of claim 10, wherein selection among said incoming directional signals from said emergency vehicles is made based upon signal strength.

12. The emergency vehicle collision avoidance system of 7, wherein an identity signal indicative of a selected emergency vehicle is broadcast in said second mode of operation by said traffic signal transceiver responsive to said means for selecting.

13. A method of operating an emergency vehicle collision avoidance system including a plurality of emergency vehicles, each emergency vehicle operating according to said method comprising the steps of:

(a) obtaining directional data indicative of a direction of travel of said emergency vehicle;

(b) sending directional signals to other emergency vehicles indicative of said directional data, said directional signals being sent in a first mode of transmission;

(c) correlating received directional signals to determine directional vectors based upon said directional signals received, and deriving relative relationships between said directional vectors; and, (d) graphically displaying said directional vectors to depict relative directions of travel of said other emergency vehicles.

14. The method of claim 13, wherein step (d) of graphically displaying further comprises graphically displaying a directional vector for a direction of travel for said emergency vehicle receiving directional signals from said other emergency vehicles.

15. The method of claim 14, wherein step (a) of determining directional data further comprises the substep of: determining location data; and step (d) of graphically displaying a directional vector further comprises the substep of: graphically displaying a direction vector for said emergency vehicles.

16. The method of claim 15, wherein said system includes at least one traffic signal having a transceiver and a controller, said method further comprising the step of:

(e) receiving at said traffic signal transceiver said signals indicative of directional data of said emergency vehicles, along with identity data of said emergency vehicles, to select an emergency vehicle from among a plurality of said emergency vehicles.

17. The method of claim 16, further comprising the step of:

(f) controlling said traffic signal responsive to directional data of said selected emergency vehicle.

18. The method of claim 17, further comprising the step of:

(g) broadcasting identity information for said selected emergency vehicle in a second mode of transmission.

19. The method of claim 18, further comprising the step of:

(h) displaying at each said emergency vehicle within range of said traffic signal transceiver an indication of said selected emergency vehicle.

20. The method of claim 19, further comprising the steps of:

(i) detecting passage of said selected emergency vehicle at said traffic signal;

(j) ending control of said traffic signal based upon directional data of said selected emergency vehicle; and, (k) broadcasting an indication to all emergency vehicles within range of said traffic signal transceiver that control of said traffic signal is no longer based upon said selected emergency vehicle.

* * * * *